US005515878A

United States Patent [19]

Wu

[11] Patent Number: 5,515,878

[45] Date of Patent: May 14, 1996

[54] SIMPLIFIED UMBRELLA WITHOUT EXTERNALLY-EXTENDED SPRING POSITIONING MEANS

[76] Inventor: Tsun-Zong Wu, P.O. Box 55-1670, Taipei, Taiwan

[21] Appl. No.: 394,355

[22] Filed: Feb. 24, 1995

[51] Int. Cl.[6] ..... A45B 25/06

[52] U.S. Cl. ..... 135/28; 135/38; 135/39; 135/40; 135/20.3

[58] Field of Search ..... 135/15.1, 27, 28, 135/37, 38, 20.3, 41, 39, 40

[56] References Cited

U.S. PATENT DOCUMENTS

| | | | |
|---|---|---|---|
| 77,975 | 5/1868 | Griswold | 135/41 |
| 144,021 | 10/1873 | Dugan et al. | 135/28 |
| 912,163 | 2/1909 | Perpich | 135/27 |
| 1,049,360 | 1/1913 | Hoffman | 135/27 |
| 1,068,376 | 7/1913 | Weber | 135/41 |
| 1,107,835 | 8/1914 | Peterson | 135/27 |
| 1,109,736 | 9/1914 | Cartwright | 135/41 |
| 2,528,002 | 10/1950 | Katzberg | 135/39 |
| 3,156,249 | 11/1964 | Biderman | 135/15.1 |
| 3,856,032 | 12/1974 | Schafer | 135/41 |
| 5,088,512 | 2/1992 | Chou et al. | 135/28 X |
| 5,427,130 | 6/1995 | Yang | 135/28 |

*Primary Examiner*—Wynn E. Wood

[57] ABSTRACT

An umbrella includes: a central shaft having an upper engaging sleeve member generally cylindrically shaped formed on an upper portion of the shaft and a lower engaging sleeve member generally cylindrically shaped formed on a lower portion of the shaft, and a C-shaped retaining ring expansibly held in a runner which is pivotally secured with a stretcher rib pivotally connected to a top rib pivotally secured to an upper notch formed on a top portion of the umbrella, whereby upon an upward movement of the runner to extend the stretcher rib and top rib for opening the umbrella and upon an expansion of the C-shaped ring to be retained on the upper engaging sleeve member, the umbrella will be opened steadily; and upon a folding of the ribs by lowering the runner and upon the expansion of the C-shaped ring to be retained on the lower engaging sleeve member, the umbrella will be closed steadily.

8 Claims, 7 Drawing Sheets

SIMPLIFIED UMBRELLA WITHOUT EXTERNALLY-EXTENDED SPRING POSITIONING MEANS

BACKGROUND OF THE INVENTION

A conventional umbrella as shown in FIG. 1 includes: a rib means 2 having a top rib 21 pivotally secured to an upper notch 11 fixed on an upper portion of a central shaft 1, a stretcher rib 22 pivotally secured to a runner 12 slidably held on the central shaft 1, whereby upon opening of the umbrella, a bottom periphery 121 of the runner 12 will be retained on an upper spring catch 13 resiliently protruding externally through an upper slot 131 cut in the central shaft; and upon closing of the umbrella (as shown in dotted lines of FIG. 1), a lower spring catch 14 as resiliently protruding externally on the central shaft 1 through a lower slot 141 cut in the shaft 1 will engage a runner slot 122 cut in the runner 12 for locking the runner 12 and the rib means 2 at a folded or closed state.

However, such a conventional umbrella will have the following drawbacks:

1. For cutting the slots 131, 141 for resiliently holding the spring catches 13, 14 in the central shaft 1, a strength of the shaft 1 will be greatly reduced, causing deformation of the shaft and influencing the opening and closing operation of the umbrella.

2. The spring catch 13, 14 is made of thin metal plate and will easily cause injury to an umbrella user when depressing the catch 13, 14 inwardly for opening or closing the umbrella.

3. If the central shaft 1 is made of metalic materials, a serious corrosion will occur at the slots 131, 141 especially after being penetrated with raindrops therein in a rainy days to easily damage the umbrella.

4. The contact area between the catch and the runner is limited to a "single spot" to easily cause wearing between the catch and the runner, possibly influencing a smooth operation of the umbrella. Meanwhile, a poor quality control for making the umbrella, such as unprecise installing of the catch in the shaft or a misalignment between the catch 14 and the runner slot 122 cut in the runner 12, may even deteriorate the umbrella.

The present inventor has found the drawbacks of the conventional umbrella, and invented the present invention by eliminating any spring positioning means externally extended on the shaft.

SUMMARY OF THE INVENTION

The object of the present invention is to provide an umbrella including: a central shaft having an upper engaging sleeve member generally cylindrically shaped formed on an upper portion of the shaft and a lower engaging sleeve member generally cylindrically shaped formed on a lower portion of the shaft, and a C-shaped retaining ring expansibly held in a runner which is pivotally secured with a stretcher rib pivotally connected to a top rib pivotally secured to an upper notch formed on a top portion of the umbrella, whereby upon the upward movement of the runner to extend the stretcher rib and top rib for opening the umbrella and upon an expansion of the C-shaped ring to be retained on the upper engaging sleeve member, the umbrella will be open steadily; and upon a folding of the ribs by lowering the runner and upon the expansion of the C-shaped ring to be retained on the lower engaging sleeve member, the umbrella will be closed steadily, thereby preventing an injury caused by contacting a conventional spring catch which is externally extended from the central shaft.

DETAILED DESCRIPTION

Figure 1:
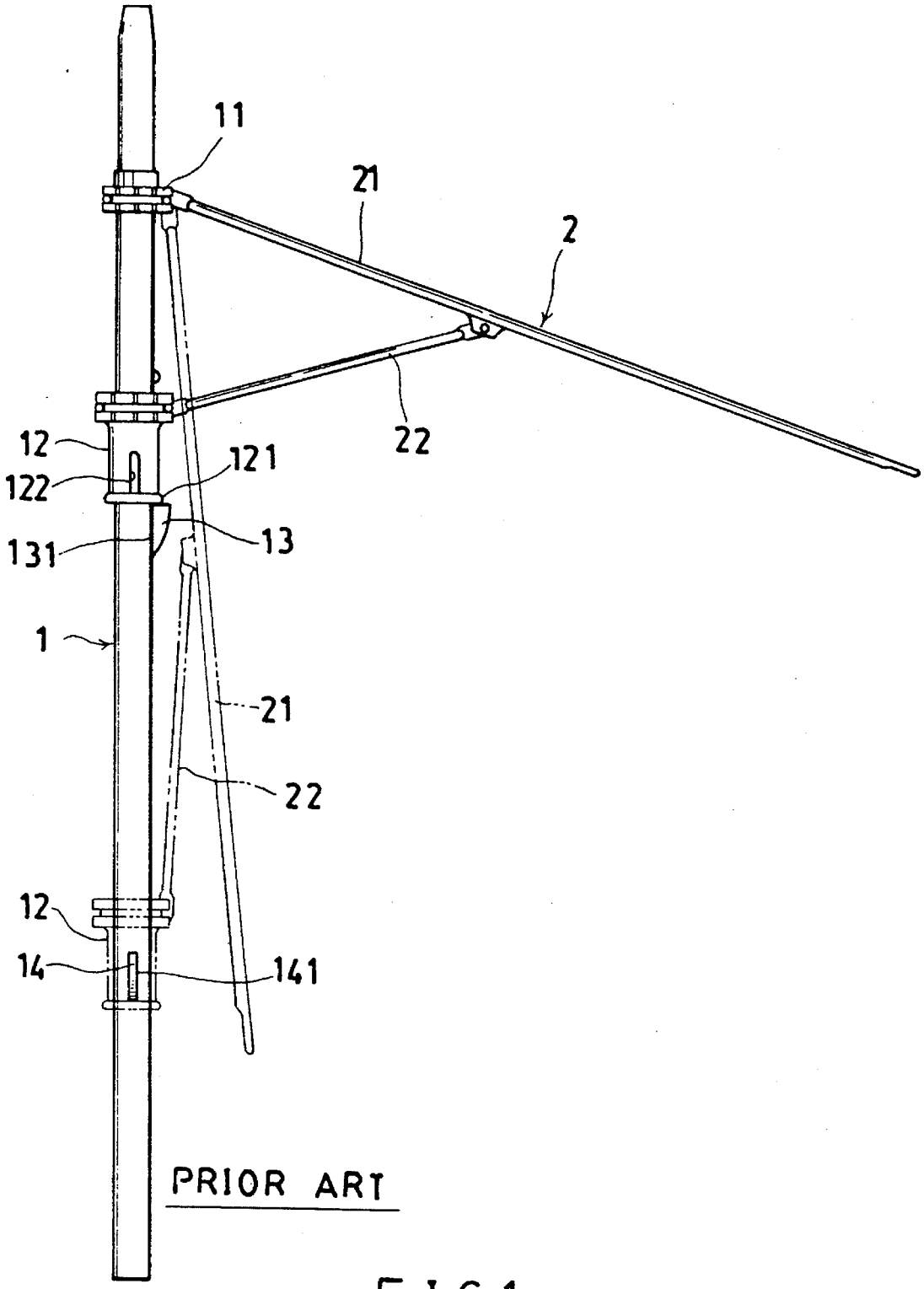
PRIOR ART FIG.1
FIG. 1 is an illustration showing a conventional single-fold umbrella having spring catches formed on the shaft.

As shown in FIGS. 2–10, the present invention comprises: a central shaft 1, a rib means 2 pivotally secured to the central shaft 1 for retaining an umbrella cloth C on the rib means 2, a retaining member 3 expansibly held in a runner 12 of the shaft 1, an upper stabilizing means 4 formed on an upper portion of the shaft 1 for engaging the retaining means 3 when opening the umbrella, and a lower stabilizing means 5 fixed on a lower portion of the shaft 1 adjacent to a handle H of the shaft 1.

The central shaft 1 includes: an upper notch 11 fixed on an upper portion of the shaft 1 for pivotally connecting an inner end portion 211 of a top rib 21 of the rib means 2, and a runner 12 slidably held on the shaft 1 for pivotally connecting an inner end portion 221 of a stretcher rib 22 having a stretcher rib axis 220 longitudinally formed at a center of the stretcher rib 22 to define an acute angle B (such as 85 degrees) between the shaft axis 100 and the rib axis 220 radially outwardly extending from the shaft 1 with a longitudinal axis 100 at a center of the central shaft 1 when opening the umbrella by engaging the runner 12 and the retaining means 3 with the upper stabilizing means 4.

Even though the drawing figures of the present invention show a single-fold umbrella configuration, but it is not limited by this invention. Plural folds of the umbrella ribs may also be modified in accordance with the present invention.

The runner 12 is generally cylindrically shaped and includes: a ferrule 120 formed on an upper portion of the runner 12 for pivotally connecting an inner end portion 221 of the stretcher rib 22 of the rib means 2, a lower extension 123 formed on a lower periphery of the runner 12, and a ring groove 123*a* annularly recessed in an inside bore portion 124 formed on an inside wall of the runner 12 and defining a central cylindrical hole within the inside bore portion 124 for expansibly holding the retaining means 3 within the ring groove 123*a* of the runner 12.

The retaining member 3 is an expansible C-shaped ring such as made of elastic metal or plastic materials and includes: an inside wall 31 defining a central aperture slidably engageable with a sleeve portion of the upper stabilizing means 4 and of the lower stabilizing means 5, a seam 32 cut through a cross section of the C-shaped ring of the retaining member 3, an arcuate upper rim 33 circumferentially formed on an upper portion of the inside wall 31 of the C-shaped ring, and an arcuate lower rim 34 circumferentially formed on a lower portion of the inside wall 31.

Besides the cylindrical or circular shapes of the elements of the present invention as illustrated, other shapes may also be modified, not limited in this invention.

Figure 2:
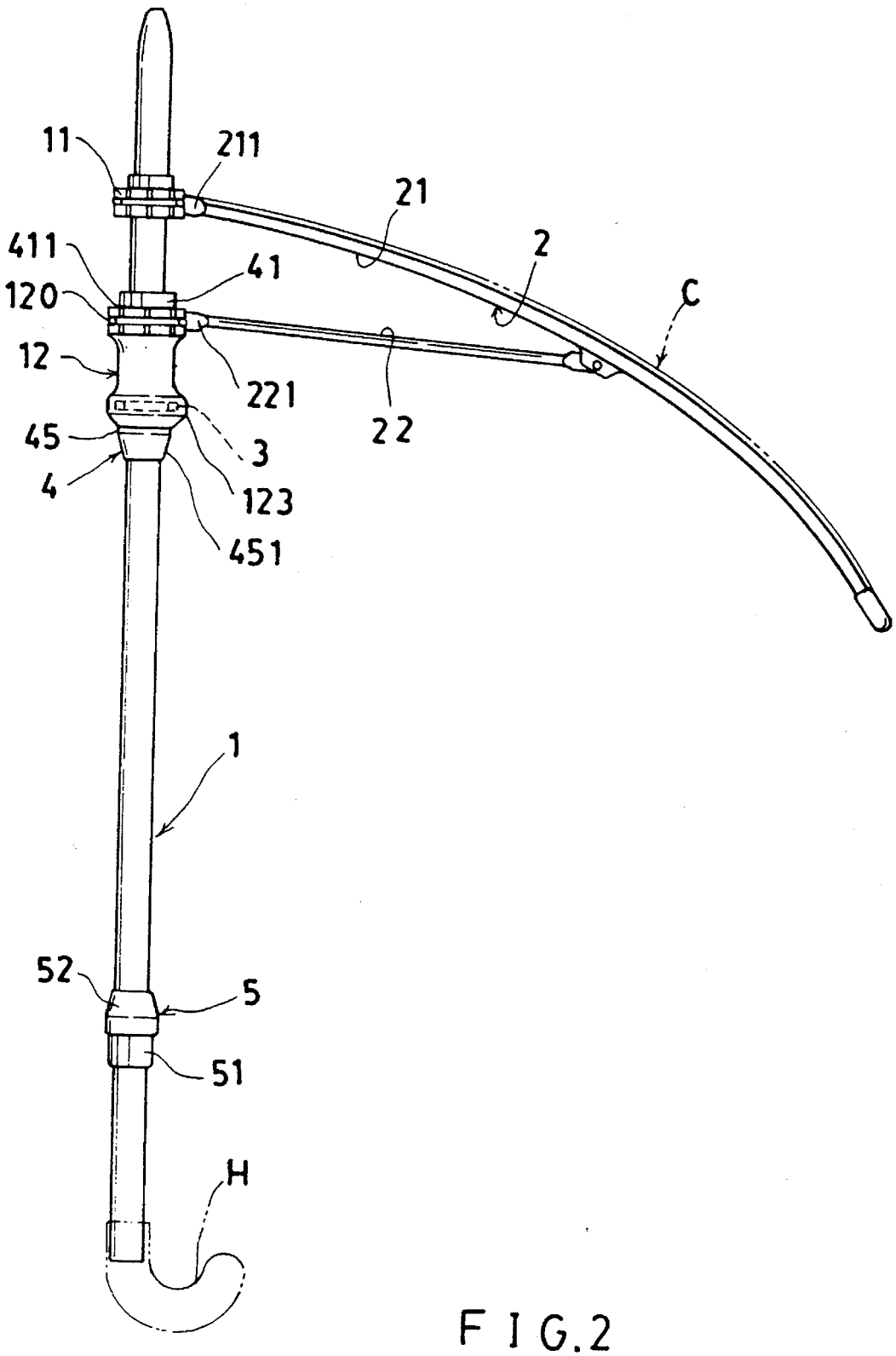
FIG. 2 is an illustration showing the umbrella of the present invention when opened.
Figure 3:
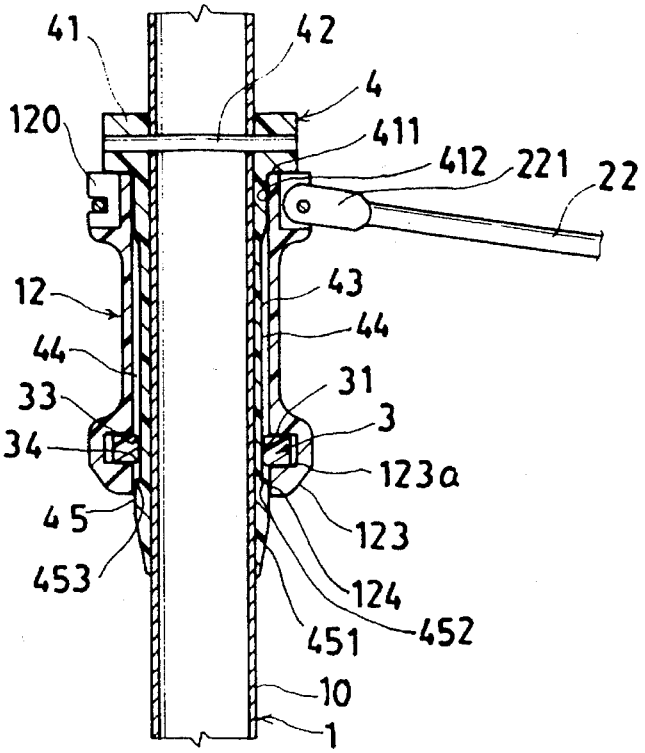
FIG. 3 is a partial sectional drawing of the runner and an upper stabilizing means of the present invention.
Figure 4:
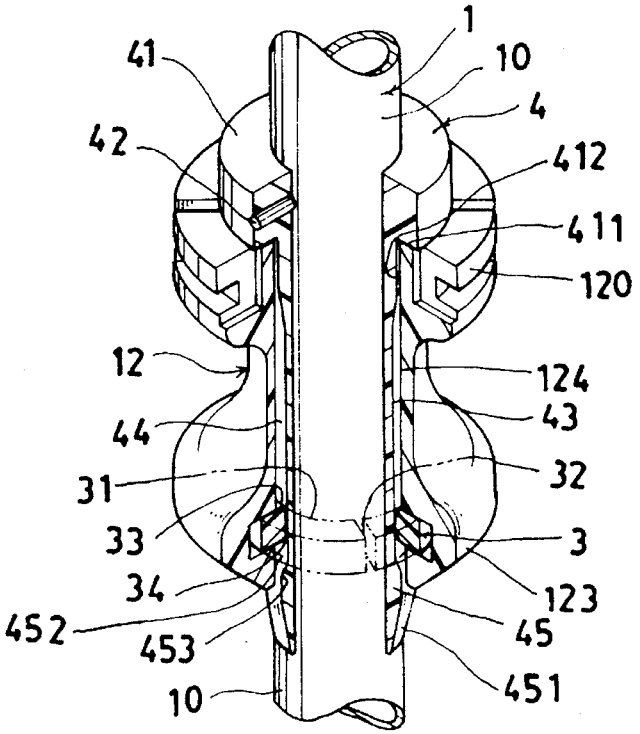
FIG. 4 is a partial cut-away perspective view of the present invention.

The upper stabilizing means 4 generally cylindrically shaped includes: an upper flange 41 secured on an upper portion of the central shaft 1 by a fixing pin 42 and having an annular shoulder portion 411 formed on a bottom portion of the flange 41 for limiting an upward movement of the ferrule 120 of the runner 12 and having an upper sleeve portion 412 protruding downwardly from the upper flange 41 for engaging an upper portion of the inside bore portion 124 of the runner 12, a narrow sleeve portion 43 protruding downwardly from the upper sleeve portion 412 for slidably engaging an inside wall 31 of the retaining member 3 when opening the umbrella as shown in FIGS. 3, 2 and an engaging sleeve portion 45 formed on a lower portion of the narrow sleeve portion 43, with the narrow sleeve portion 43 radially recessed inwardly from an outer cylindrical surface of the upper sleeve portion 412 and of the engaging sleeve portion 45 to have an outside diameter of the narrow sleeve portion 43 smaller than an outside diameter of each upper sleeve portion 412 and engaging sleeve portion 45 to define a cylindrical aperture 44 between the narrow sleeve portion 43 and the inside bore portion 124 in the runner 12 for resiliently protruding the inside wall 31 of the retaining member 3 inwardly to be retained on the outside diameter of the narrow sleeve portion 43 when opening the umbrella by engaging the retaining member 3 with the upper stabilizing means 4 on the central shaft 1.

Figure 7:
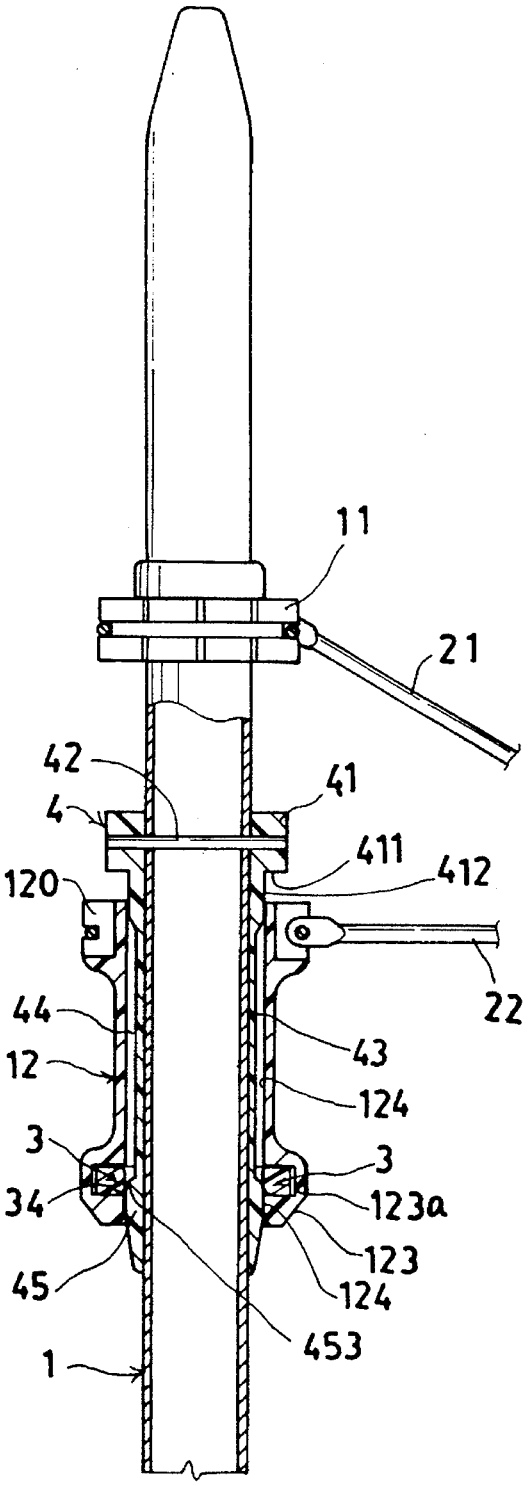
FIG. 7 is a partial sectional drawing of the present invention when instantly unlocking the runner from the upper stabilizing means fixed on the shaft.
Figure 8:
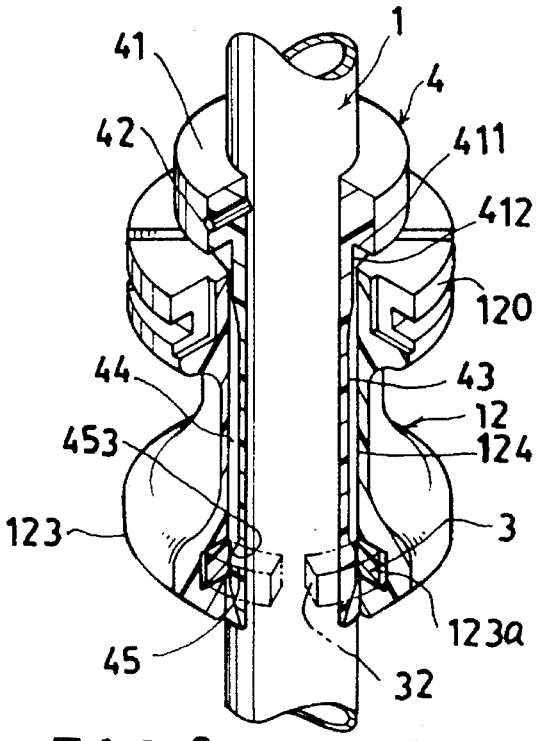
FIG. 8 is partial perspective view of FIG. 7 in accordance with the present invention.

The engaging sleeve portion 45 formed on a lower portion of the upper stabilizing means 4 includes: an annular hook portion 452 circumferentially formed on a lower portion of the narrow sleeve portion 43 for engaging the retaining member 3 when opening the umbrella, a guiding slope portion 451 tapered downwardly towards a handle H of the shaft 1 from the hook portion 452 to be tangential to a cylindrical tube surface 10 of the shaft 1, and an arcuate rim portion 453 formed between the hook portion 452 and the slope portion 451 for a smooth engagement with an upper rim 33 and a lower rim 34 formed on an inside wall 31 of the retaining member 3 for an easier engagement with or disengagement from the arcuate rim portion 453 formed on the engaging sleeve portion 45 especially as shown in FIGS. 7, 8.

Figure 9:
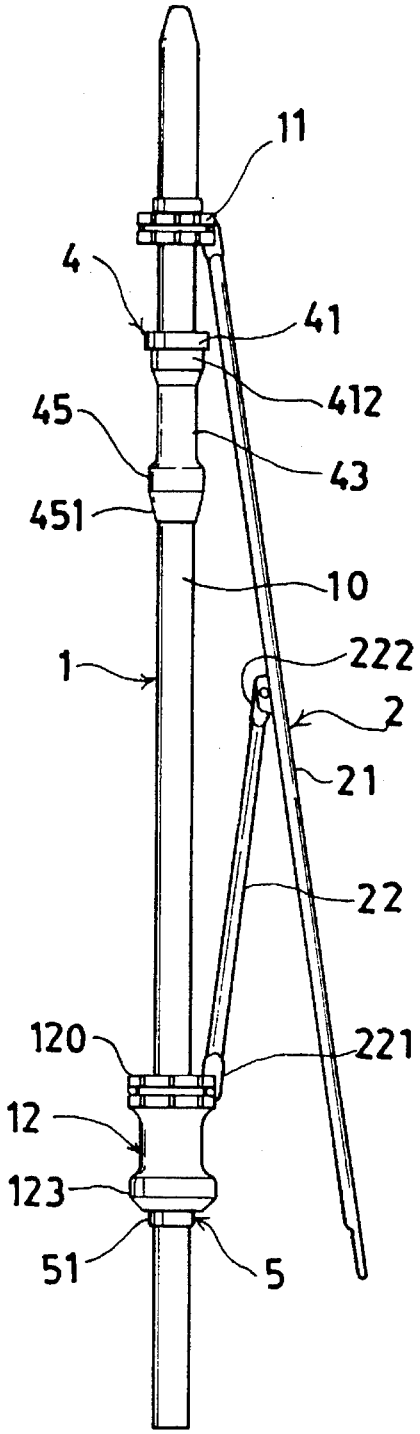
FIG. 9 is an illustration showing a folded umbrella of the present invention.
Figure 10:
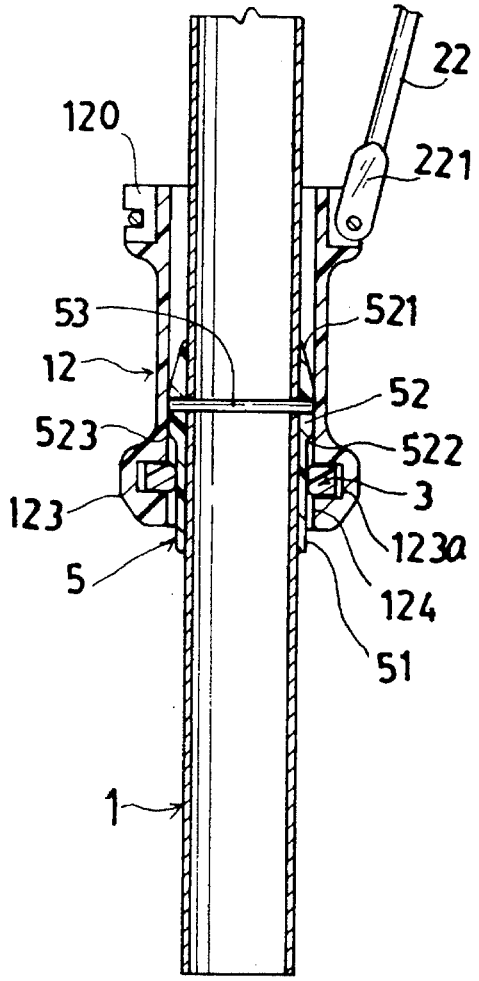
FIG. 10 is a partial sectional drawing of the present inventin when folded.

The lower stabilizing means 5 as shown in FIGS. 10, 9 includes: an engaging sleeve portion 52 secured on a lower portion of the central shaft 1 by a fixing pin 53, and a narrow sleeve portion 51 protruding downwardly from the engaging sleeve portion 52 and having an outside diameter of the narrow sleeve portion 51 smaller than an outside diameter of the engaging sleeve portion 52 for holding the inside wall 31 of the retaining member 3 when folding the rib means 2 for closing the umbrella, with the engaging sleeve portion 52 limiting an upward movement of the retaining member 3 for stably closing the umbrella.

The engaging sleeve portion 52 of the lower stabilizing means 5 includes: an annular hook portion 522 circumferentially formed on an upper portion of the narrow sleeve portion 51 for engaging the retaining member 3 when closing the umbrella by sliding an inside bore portion 124 in the runner 12 on the engaging sleeve portion 52, a guiding slope portion 521 tapered upwardly towards an upper portion of the shaft 1 from the hook portion 522 to be tangential to a cylindrical tube surface 10 of the shaft 1, and an arcuate rim portion 523 formed between the hook portion 522 and the slope portion 521 for a smooth engagement with an upper rim 33 and a lower rim 34 formed on the inside wall 31 of the retaining member 3 for an easier engagement with or disengagement from the arcuate rim portion 523 formed on the engaging sleeve portion 52.

Figure 5:
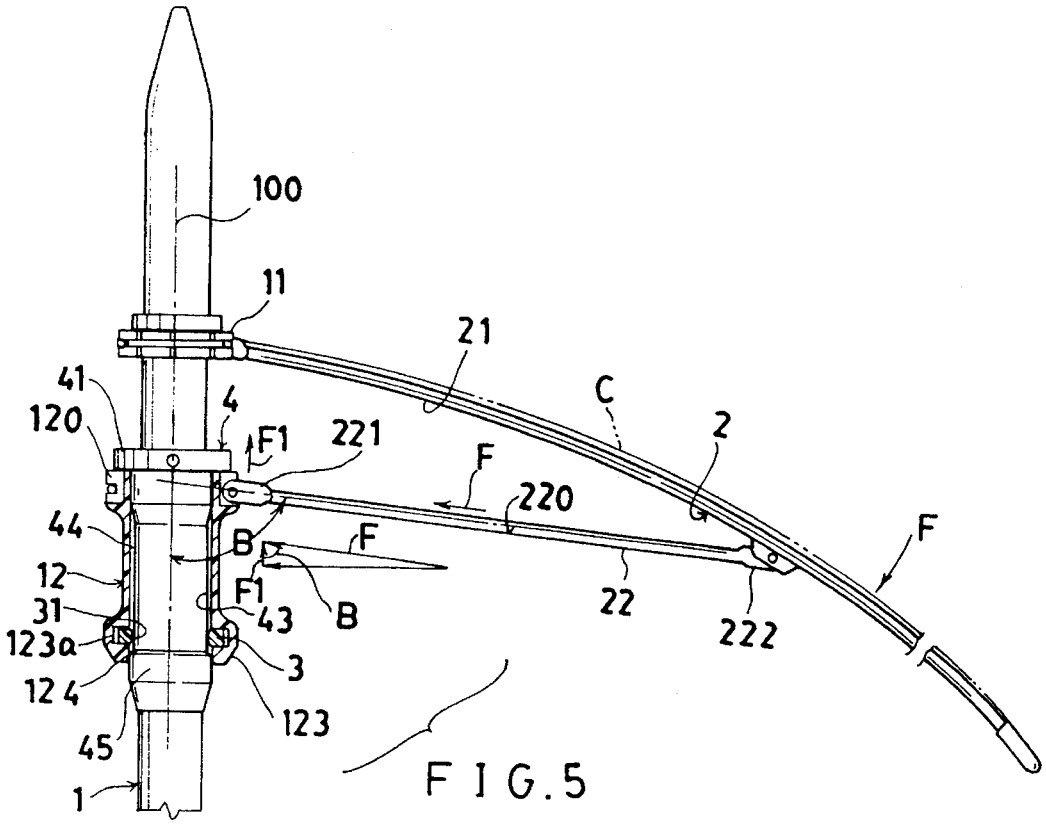
FIG. 5 is an illustration showing the influence by a tension force caused by the umbrella cloth or downwardly blowing wind.

When opening the umbrella as shown in FIGS. 2, 3, 5, a tension force F such as the force downwardly acting upon the ribs 22 by the umbrella cloth C or by a downwardly blowing wind (not shown) may produce an upward force fraction F1 forcing the runner 12 upwardly towards a top end of the shaft 1 to thereby prevent an automatic closing or folding of the ribs 22, 21 as effected by a gravitational force acting on the ribs 22, 21. The upward movement of each rib 22 and ferrule 120 will be obstructed by the shoulder portion 411 of the upper stabilizing means 4 for limiting the upward movement of the runner 12. While a gravitational or spontaneous downward movement of the runner 12 and the rib means 2 will be prevented since the retaining member 3 will be retarded by the hook portion 452 of the upper stabilizing means 4, thereby stably keeping the umbrella at its open state.

When closing the umbrella from FIG. 2 to FIG. 9, the runner 12 can be lowered to expand the C-shaped retaining member 3 to open the seam 32 of the retaining member 3 to pass through the engaging sleeve portion 45 to disengage the retaining member 3 from the upper stabilizing means 4 until the retaining member 3 is re-locked on the lower stabilizing means 5 as shown in FIG. 10.

Figure 6:
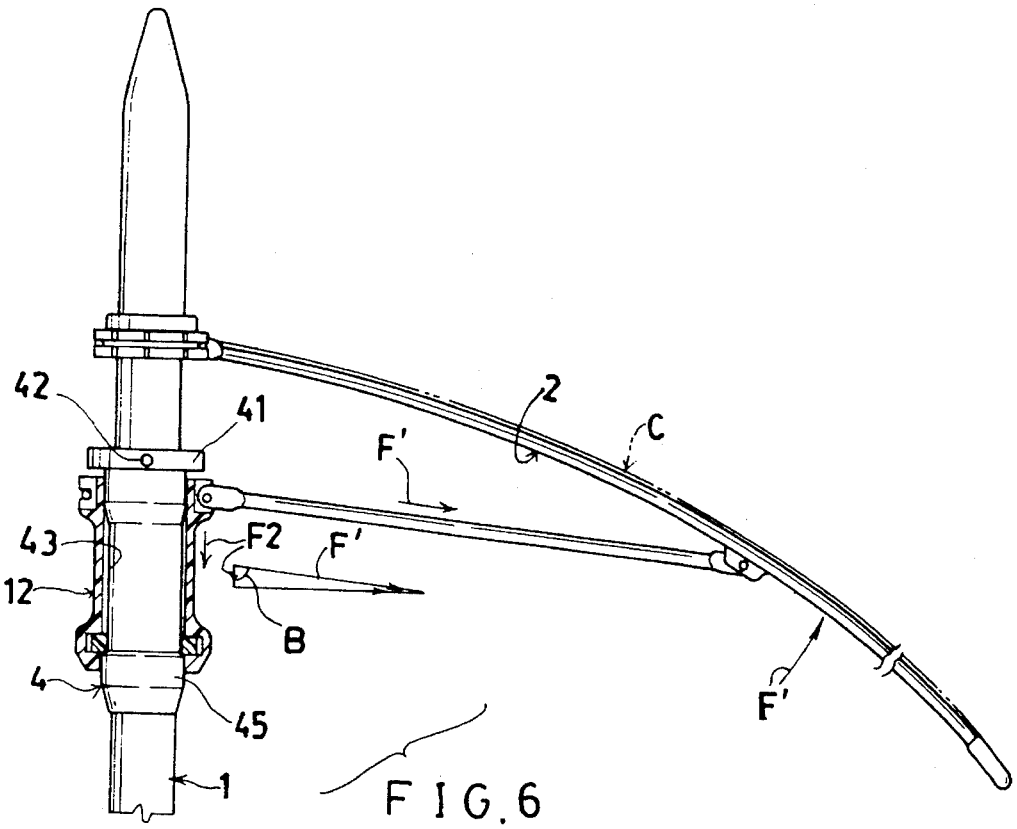
FIG. 6 shows the influence by a pulling force acting on the umbrella cloth upwardly such as caused by an upwardly blowing wind.

As shown in FIG. 6, when an opened umbrella is subjected to an external force F' such as an upwardly blowing wind, the upwardly pulling force F' will produce a downwardly acting force fraction F2 thrusting the runner 12 downwardly. Since the angle B between the shaft 1 and the rib 22 is an acute angle, such as 85°, the downwardly acting fraction F2 is too small to be appreciated. The force for expanding the C-shaped ring 3 of this invention to be disengaged from the upper stabilizing means 4 can be designed to be enough and larger than the force fraction F2 downwardly acting the runner 12 to prevent an unexpected automatic closing of the umbrella from its opened state.

The present invention is superior to a conventional umbrella having spring catch resiliently formed on a shaft with the following advantages:

1. There is no spring catch formed through a tubular wall of the central shaft to prevent a cutting injury to the umbrella user by the spring catch.

2. The shaft 1 will not be notched with any slot for holding the spring catch to prevent decrease of the mechanical strength of the shaft. Therefore, the shaft tube may be made thinner without influencing the tubular strength, but decreasing the production cost thereof. The shaft 1 may be integrally formed such as by plastic molding process for reducing the production cost.

3. Easier assembly, lower cost, minor maintenance problem, and better quality control of the umbrella can be enhanced.

Figure 11:
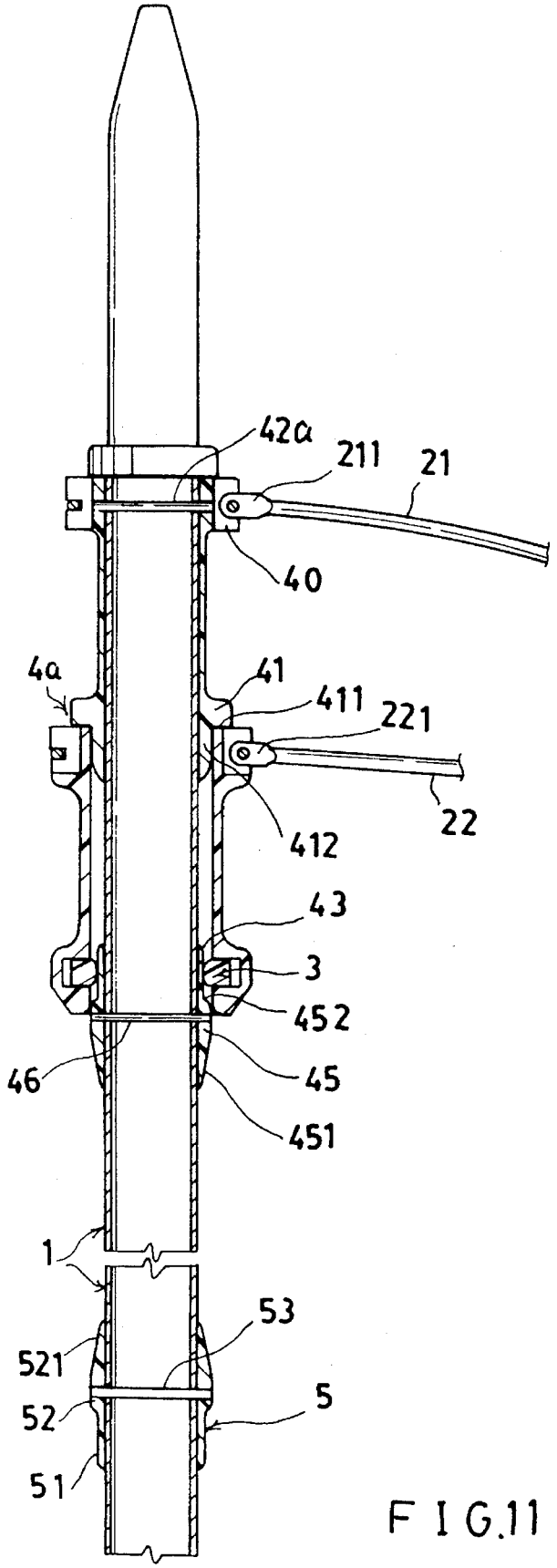
FIG. 11 shows another preferred embodiment of the present invention.

As shown in FIG. 11, the upper stabilizing means 4*a* may be modified to include: an upper notch 40 protruding upwardly from the upper flange 41 and secured on a top portion of the central shaft by a fixing pin 42*a*, an engaging sleeve portion 45 secured on an upper portion of the shaft 1 by a fixing pin 46 below the upper flange 41 and having a guiding slope portion 451 tapered downwardly from an annular hook portion 452 formed on a lower portion of a narrow sleeve portion 43 disposed on the shaft 1 discontinued from and positioned below an upper sleeve portion 412 of the upper flange 41, with the runner 12 retained between the upper flange 41 and the engaging sleeve portion 45 when opening the umbrella; with the narrow sleeve portion 43 and the engaging sleeve portion 45 being geometrically identical with the lower stabilizing means 5. The lower stabilizing means 5 including the engaging sleeve portion 52 and the narrow sleeve portion 51 can be inverted from upside down to serve as the narrow sleeve portion 43 and the engaging sleeve portion 45 of the upper stabilizing means 4, thereby saving molding cost when preparing the molds for making the narrow sleeve portions 43, 51 and the engaging sleeve portions 45, 52, suitably applicable for both the upper stabilizing means 4 and lower stabilizing means 5.

I claim:

1. An umbrella comprising:

a central shaft (1) having an upper notch (11) secured on an upper portion of said shaft (1), and a runner (12) slidably held on said shaft (1);

a rib means (2) having at least a top rib (21) pivotally secured to said upper notch (11) of said shaft (1), and at least a stretcher rib (22) pivotally connected between said runner (12) and each said top rib (21);

an upper stabilizing means (4) generally cylindrically shaped and fixed on an upper portion of said shaft (1) below said upper notch (11) and engageable with a retaining member (3) expansibly held in said runner (12); and a lower stabilizing means (5) generally cylindrically shaped and fixed on a lower portion of said shaft (1) adjacent to a handle (H) of said shaft (1) and engageable with the retaining member (3) expansibly held in said runner (12);

whereby upon upward movement of said runner (12) to extend said rib means (2) to engage said retaining member (3) on said upper stabilizing means (4), said umbrella will be opened steadily; and upon downward movement of said runner (12) to retract said rib means (2) to engage said retaining member (3) with said lower stabilizing means (5), said umbrella will be closed steadily;

said runner (12) generally cylindrically shaped and including: a ferrule (120) formed on an upper portion of the runner (12) for pivotally connecting an inner end portion (221) of each said stretcher rib (22) of the rib means (2), a lower extension (123) formed on a lower periphery of the runner (12), and a ring groove (123*a*) annularly recessed in an inside bore portion (124) formed on an inside wall of the runner (12) and defining a central cylindrical hole within the inside bore portion (124) for expansibly holding the retaining means (3) within the ring groove (123*a*) of the runner (12); and said retaining member (3) formed as an expansible C-shaped ring and including: an inside wall (31) defining a central aperture slidably engageable with a sleeve portion of each said upper stabilizing means (4) and said lower stabilizing means (5), a seam (32) cut through a cross section of the C-shaped ring of the retaining member (3), an arcuate upper rim (33) circumferentially formed on an upper portion of the inside wall (31) of the C-shaped ring, and an arcuate lower rim (34) circumferentially formed on a lower portion of the inside wall (31).

2. An umbrella according to claim 1, wherein said upper stabilizing means (4) is generally cylindrically shaped and includes: an upper flange (41) secured on an upper portion of the central shaft (1) by a fixing pin (42) and having an annular shoulder portion (411) formed on a bottom portion of the flange (41) for limiting an upward movement of the ferrule (120) of the runner (12) and having an upper sleeve portion (412) protruding downwardly from the upper flange (41) for engaging an upper portion of the inside bore portion (124) of the runner (12), a narrow sleeve portion (43) protruding downwardly from the upper sleeve portion (412) for slidably engaging an inside wall (31) of the retaining member (3) when opening the umbrella, and an engaging sleeve portion (45) formed on a lower portion of the narrow sleeve portion (43), with the narrow sleeve portion (43) radially recessed inwardly from an outer cylindrical surface of the upper sleeve portion (412) and the engaging sleeve portion (45) to have an outside diameter of the narrow sleeve portion (43) smaller than an outside diameter of each said upper sleeve portion (412) and each said engaging sleeve portion (45) to define a cylindrical aperture (44) between the narrow sleeve portion (43) and the inside bore portion (124) of the runner (12) for resiliently protruding the inside wall (31) of the retaining member (3) inwardly to be retained on the outside diameter of the narrow sleeve portion (43) when opening the umbrella by engaging the retaining member (3) with the upper stabilizing means (4) on the central shaft (1).

3. An umbrella according to claim 2, wherein said engaging sleeve portion (45) formed on a lower portion of the upper stabilizing means (4) includes: an annular hook portion (452) circumferentially formed on a lower portion of the narrow sleeve portion (43) for engaging the retaining member (3) when opening the umbrella, a guiding slope portion (451) tapered downwardly towards a handle (H) of the shaft (1) from the hook portion (452) to be tangential to a cylindrical tube surface (10) of the shaft (1), and an arcuate rim portion (453) formed between the hook portion (452) and the slope portion (451) for a smooth engagement with an upper rim (33) and a lower rim (34) formed on an inside wall (31) of the retaining member (3).

4. An umbrella according to claim 1, wherein said lower stabilizing means (5) includes: an engaging sleeve portion (52) secured on a lower portion of the central shaft (1) by a fixing pin (53), and a narrow sleeve portion (51) protruding downwardly from the engaging sleeve portion (52) and having an outside diameter of the narrow sleeve portion (51) smaller than an outside diameter of the engaging sleeve portion (52) for holding the inside wall (31) of the retaining member (3) when folding the rib means (2) for closing the umbrella, with the engaging sleeve portion (52) limiting an upward movement of the retaining member (3) for stably closing the umbrella.

5. An umbrella according to claim 4, wherein said engaging sleeve portion (52) of the lower stabilizing means (5) includes: an annular hook portion (522) circumferentially formed on an upper portion of the narrow sleeve portion (51) for engaging the retaining member 3 when closing the umbrella, a guiding slope portion (521) tapered upwardly towards an upper portion of the shaft (1) from the hook portion (522) to be tangential to a cylindrical tube surface (10) of the shaft (1), and an arcuate rim portion (523) formed between the hook portion (522) and the slope portion (521).

6. An umbrella according to claim 1, wherein said upper stabilizing means (4) includes: an upper flange (41) for limiting an upward movement of the runner (12) when opening the umbrella and having an upper notch (40) protruding upwardly from said upper flange (41) for pivotally connecting the top rib (21) with said upper notch (40) secured on a top portion of said shaft (1); an engaging sleeve portion (45) formed on a lower portion of a narrow sleeve portion (43) disposed on said shaft (1) below said upper flange (41) for retaining said runner (12) between said upper flange (43) and said engaging sleeve portion (45) when opening the umbrella for engaging the retaining member (3) on said engaging sleeve portion (45) and said narrow sleeve portion (43), with said engaging sleeve portion (45) secured on said shaft (1) by a fixing pin (46) and separable from said upper flange (41).

7. An umbrella according to claim 6, wherein said engaging sleeve portion (45) is formed on a lower portion of said narrow sleeve portion (43) and includes a hook portion (452) connected with said narrow sleeve portion (43) for engaging said retaining member (3), and a guiding slope portion (451) tapered downwardly from said hook portion (452) to be tangential to a cylindrical tube surface (10) of said shaft (1).

8. An umbrella according to claim 7, wherein said engaging sleeve portion (45) connected with said narrow sleeve portion (43) is inverted to have said guiding slope portion (451) tapered upwardly from said hook portion (452) towards an upper portion of said shaft (1), with said narrow sleeve portion (43) positioned below said hook portion (452) of said engaging sleeve portion (45), to be a lower stabilizing means (5) secured at a lower portion of said shaft (1).

* * * * *